US009315201B2

(12) United States Patent
Wellman

(10) Patent No.: US 9,315,201 B2
(45) Date of Patent: Apr. 19, 2016

(54) HOPPER GATE OPENER

(71) Applicant: John Wellman, Hampton, MN (US)

(72) Inventor: John Wellman, Hampton, MN (US)

( * ) Notice: Subject to any disclaimer, the term of this patent is extended or adjusted under 35 U.S.C. 154(b) by 72 days.

(21) Appl. No.: 13/800,318

(22) Filed: Mar. 13, 2013

(65) Prior Publication Data

US 2013/0291760 A1 Nov. 7, 2013

Related U.S. Application Data

(60) Provisional application No. 61/642,796, filed on May 4, 2012, provisional application No. 61/693,899, filed on Aug. 28, 2012.

(51) Int. Cl.

| | |
|---|---|
| ***B61D 7/30*** | (2006.01) |
| ***B61D 7/28*** | (2006.01) |
| ***B61D 7/02*** | (2006.01) |

(52) U.S. Cl.

CPC ... *B61D 7/02* (2013.01); *B61D 7/30* (2013.01)

(58) Field of Classification Search

CPC ..... B61D 7/00; B61D 7/02; B61D 7/14; B61D 7/16; B61D 7/18; B61D 7/24; B61D 7/26; B61D 7/28; B61D 7/30

USPC ..... 105/238.1, 239, 241.1, 241.2, 286

See application file for complete search history.

(56) References Cited

U.S. PATENT DOCUMENTS 1,374,248 A 4/1921 Geo
3,409,158 A * 11/1968 Lull ..... B66F 9/127 414/11
3,444,583 A * 5/1969 Laurel ..... 15/340.3

FOREIGN PATENT DOCUMENTS

CA 1193141 * 9/1985 ..... B61D 7/28

OTHER PUBLICATIONS

Mill & Elevator Supply Co., Inc., Skidsteer Hydraulic Hopper Gate Opener, http://www.millelevatorsupply.com/product/Skidsteer_Hydraulic_Hopper_Gate_Opener-1657.html.

The Arnold Company, Door Demon Side Shifter, Hopper Gate Door Opener, www.arnoldcompany.com.

* cited by examiner

*Primary Examiner* — R. J. McCarry, Jr.

(74) *Attorney, Agent, or Firm* — Beck Tysver Evans, PLLC; Daniel Tysver; Daniel Tysver

(57) ABSTRACT

A rail car hopper gate opener is presented attached to a moving vehicle. A mechanized gate opener is attached to one end of the vehicle. The gate opener is attached in such as manner as to allow the gate opener to rise and fall with respect to the vehicle, to rotate with respect to the vehicle, to extend away and retract back toward the vehicle, and to pivot on a hinge on the vehicle attachment point.

20 Claims, 10 Drawing Sheets

HOPPER GATE OPENER

RELATED APPLICATIONS

This application claims the benefit of U.S. Provisional Application No. 61/642,796, filed May 4, 2012, and U.S. Provisional Application No. 61/693,899, filed Aug. 28, 2012. Both of the above referenced patent applications are incorporated herein in their entirety.

FIELD OF THE INVENTION

The present application relates to the field of slide gate openers for hopper rail cars. More particularly, the described embodiments relate to a mechanized gate opener.

SUMMARY

The present invention provides for a slide gate opener attached to a moving vehicle such as a small tractor. In one embodiment, the user sits forward on the tractor while moving on the tractor parallel to the rail line. The mechanized gate opener is attached to one end of the tractor in such as manner as to allow the gate opener to rise and fall with respect to the tractor, to tilt with respect to the tractor, and to extend away and retract back toward the tractor. In this way, the opener is able to access the pinion shaft of the slide gate of the rail car regardless of whether the tractor is elevated above or below the rail line, and regardless of whether the tractor is inclined toward or away from the rail car. When the opener has engaged the pinion shaft of the slide gate, the opener rotates so as to open or close the slide gate. In one embodiment, the gate opener is attached to the vehicle via a sturdy hinge that allows the entire opener to swivel on the hinge. Springs attached to either side of the hinge bias the opener to a center position on the hinge allowing movement in either direction at the hinge. The springs allow movement of at the hinge to compensate for misalignments between the opener shaft and the pinion shaft of the slide gate.

DETAILED DESCRIPTION

Hopper cars are equipped with a sliding gate (or "slide gate") that opens and closes the discharge opening of the hopper. Typically, sliding gates operate on a rack and pinion mechanism, where a rotational motion is applied to a pinion gear, which engages a rack in order to laterally move the slide gate open and closed. Sliding gates must be open to discharge the contents of a hopper car, and closed before the hopper car is re-loaded. In addition, when rail hopper cars are to be loaded, it is often necessary to open the slide gate temporarily in order to clean some remaining product from the last shipment out of the car. This cleaning process typically takes place away from the unloading area for the hopper cars, far away from automated systems that can work only in those designated unloading areas. As a result, slide gates are usually opened and closed during cleaning via a manual process in which workers rotate the pinion gear manually with pry bars. Often the slide gates are difficult to open and close because of the age or poor maintenance of the slide gates, or because product gets trapped in the slide gate mechanism and causes the slide gate to bind or jam. Regardless of the cause, workers often find that the slide gates resist manual opening and closing, frequently causing personal injury to the workers operating the pry bars. Although automated mechanisms exist for opening and closing the slides on hopper cars, no known machine can easily do this process in remote locations such as railroad side tracks or holding yards where the cleaning operation typically takes place. Often these yards have several tracks built on loose and rough terrain that make it difficult to bring mechanized opening and closing devices to the slide gate opening mechanism. Known prior art systems that can operate a slide gate's opening mechanism will not function in this environment, as they require i) a flat, stable surface running parallel to the railroad tracks, ii) a second railroad track running parallel at a known distance from the track upon which the hopper car resides, or iii) space to approach the railroad hopper car perpendicularly which may not be possible in railroad yards with tightly spaced tracks.

Figure 1:
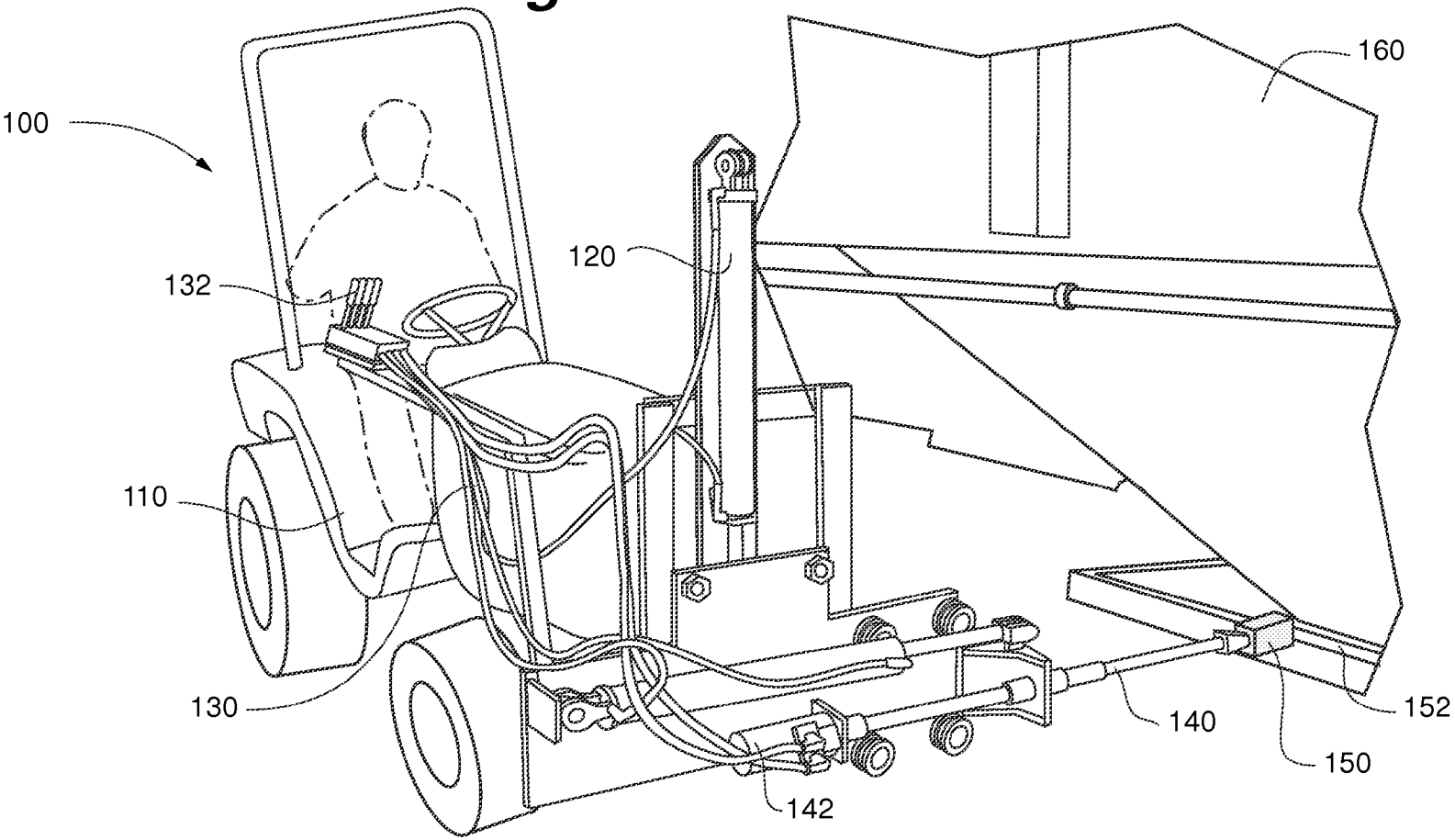
FIG. 1 is a perspective view of a slide gate opener on a tractor being used to open a slide gate on a hopper rail car.

FIG. 1 shows one embodiment of an automated hopper gate opener system 100 that can function in this environment. The system includes a small four-wheel drive tractor 110 that has a front facing driver's seat. Suitable tractors are manufactured by a variety of third party manufacturers. One such tractor is the B-series tractor made by Kubota Corporation (Osaka, JP). Attached to this tractor 110 is a hopper gate opener 120 that is operated using the hydraulics on the tractor 110. The combination of the tractor 110 and the hopper gate opener 120 provides a very compact and maneuverable system 100 that can easily be used at multiple locations.

Hydraulic hoses 130 run from controllers 132 positioned near the operator in order to operate the various hydraulic systems on the attachment 120. These controls 132 allow an operator to position an opener shaft 140 of the hopper gate opener 120 into the pinion portion 150 of a slide gate 152 found on a the hopper rail car 160. After positioning the opener shaft 140 to engage the pinion 150, the operator uses the controls 132 to rotate the opener shaft 140 in order to open or close the hopper slide gate 152.

As shown in FIG. 1, the tractor 110 is driven parallel to the hopper rail car 160. This allows the driver to move easily between multiple cars 160 on the same tracks simply by driving parallel to the tracks. This would be possible even if a separate train occupied another set of tracks found on the right side of the tractor 110. Because the tractor has four-wheel drive, it can drive though difficult conditions and can easily be used on rough and uneven terrain.

Figure 2:
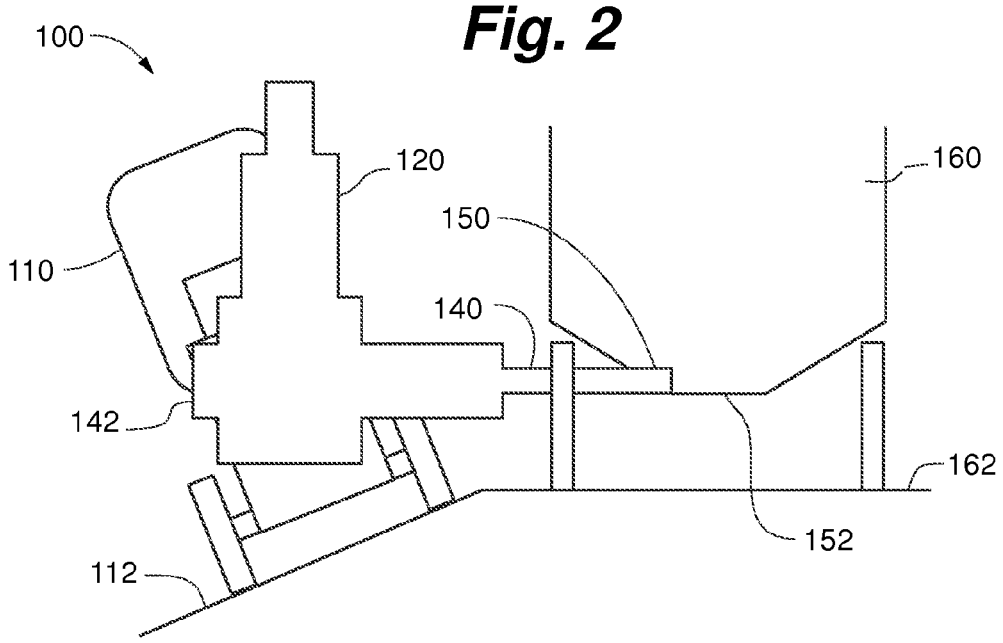
FIG. 2 is a schematic front view of a tractor on an incline using a slide gate opener to open a slide gate on a hopper rail car.

The hopper gate opener 120 is designed to turn when attached to the tractor 110, as shown schematically in FIG. 2. This allows the tractor to be on uneven ground 112 adjacent to the rail car 160. The turntable mechanism of the hopper gate opener 120 is able to twist with respect to the tractor 110 such that the opener shaft 140 can approach the pinion portion 150 roughly parallel with the ground 162 upon which the rail car 160 sits. This allows the opener shaft 140 to be extended directly into the receiving portion of the pinion gear 150.

Figure 3:
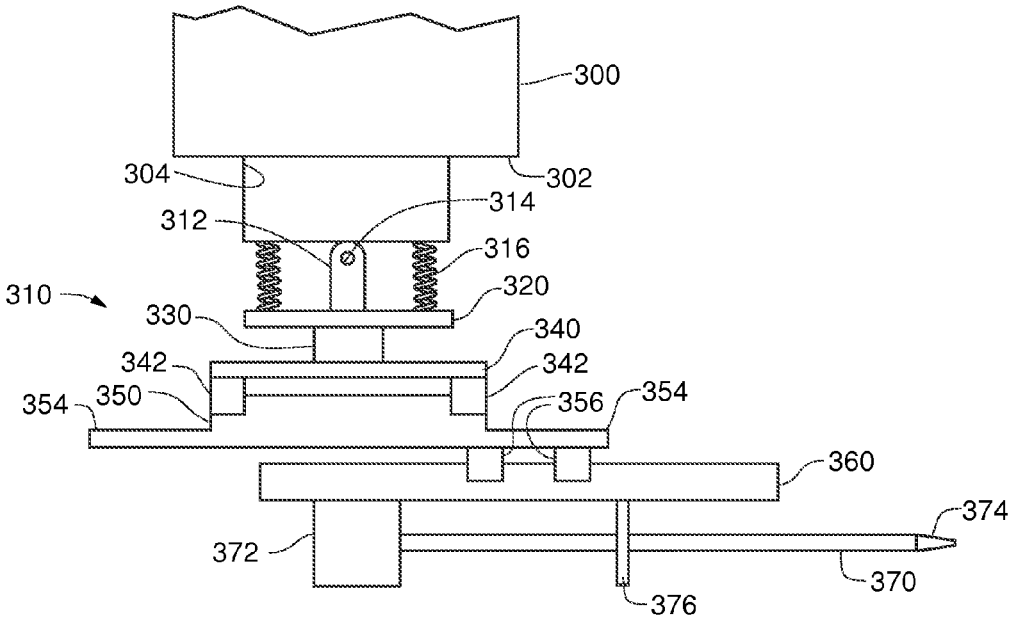
FIG. 3 is a schematic, top view of a slide gate opener attached to a tractor.
Figure 4:
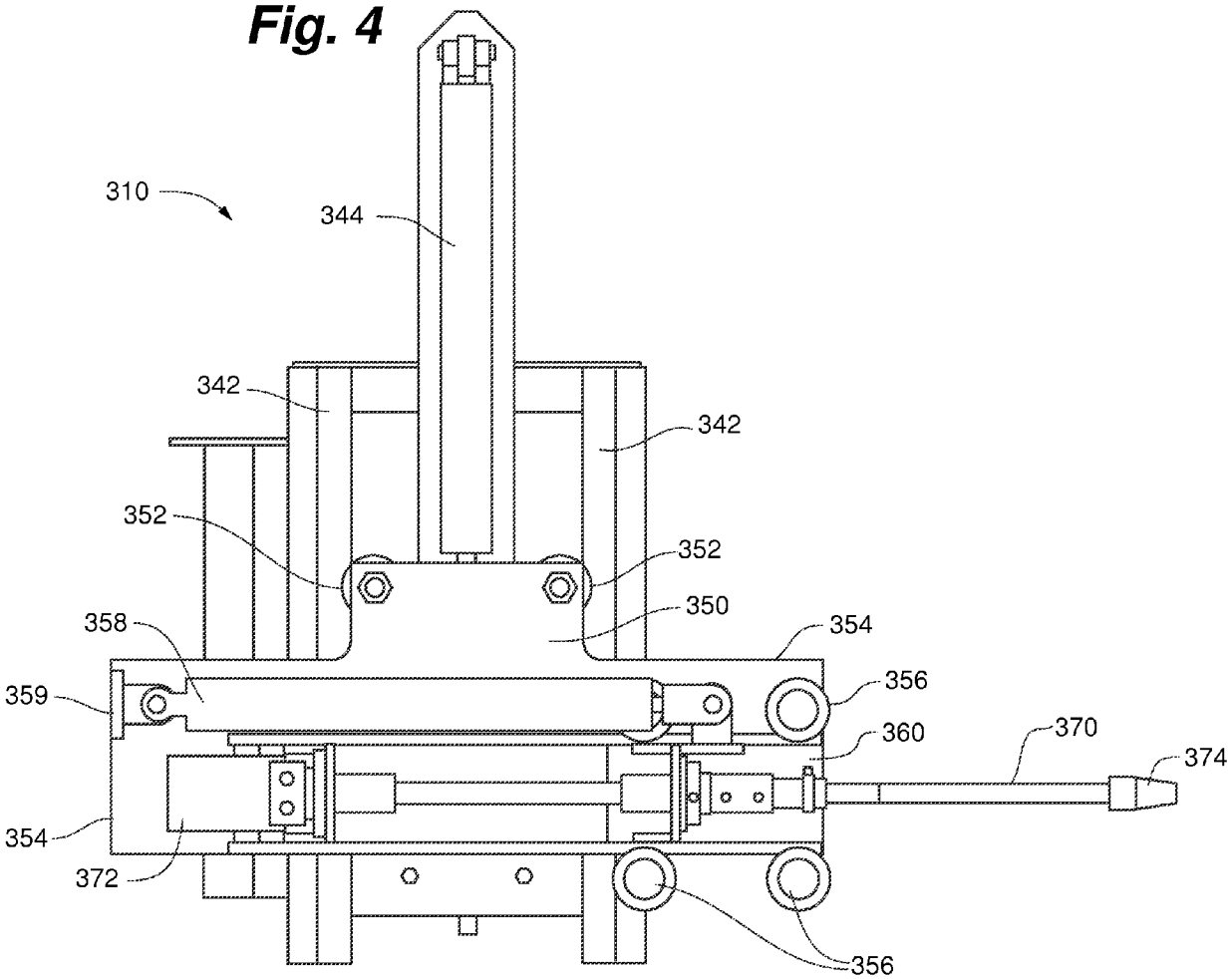
FIG. 4 is a front plan view of a slide gate opener having the same general construction as the slide gate opener of FIG. 3.
Figure 5:
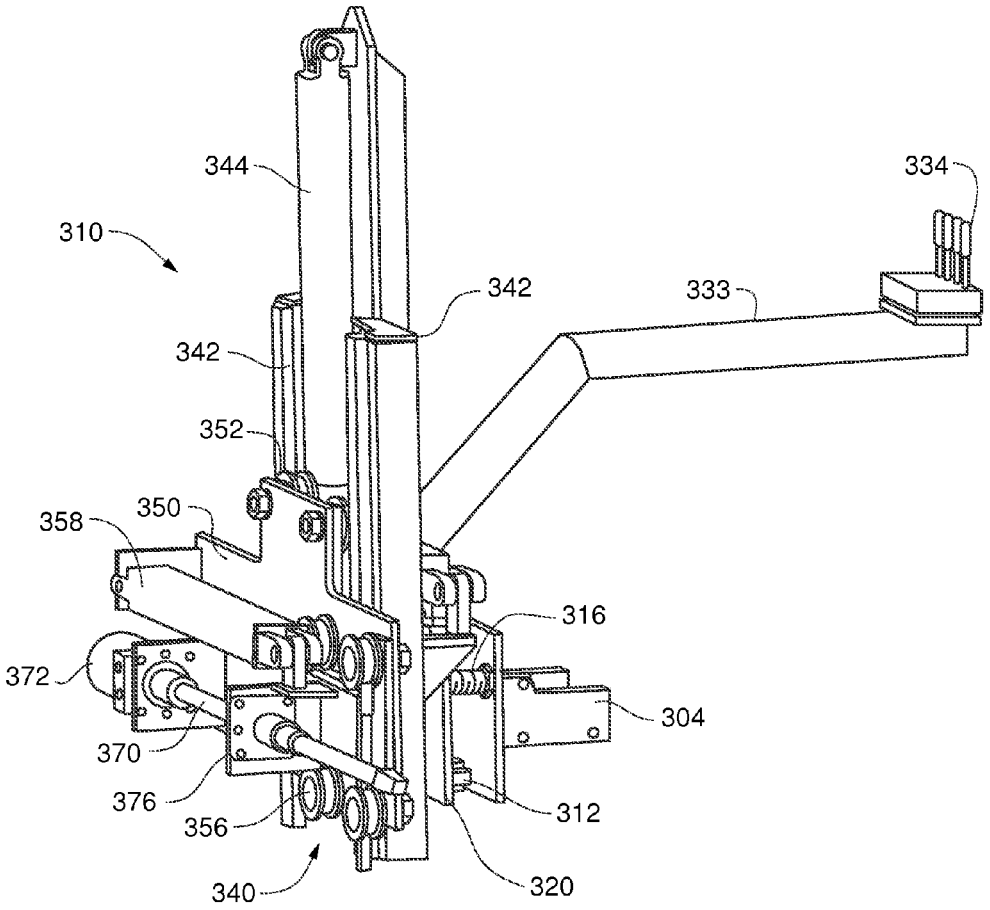
FIG. 5 is a perspective view of the slide gate opener of FIG. 4.
Figure 6:
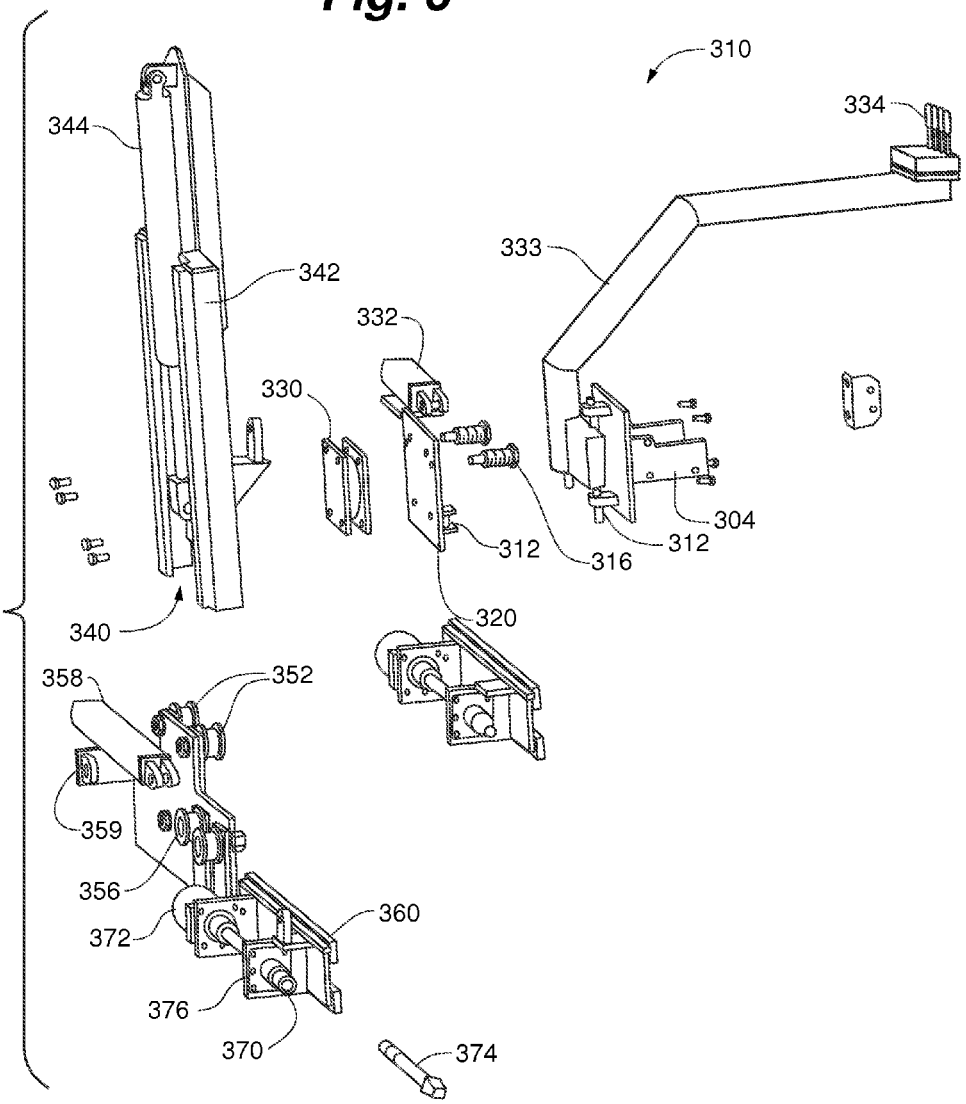
FIG. 6 is a perspective, exploded view of the slide gate opener of FIG. 4.
Figure 7:
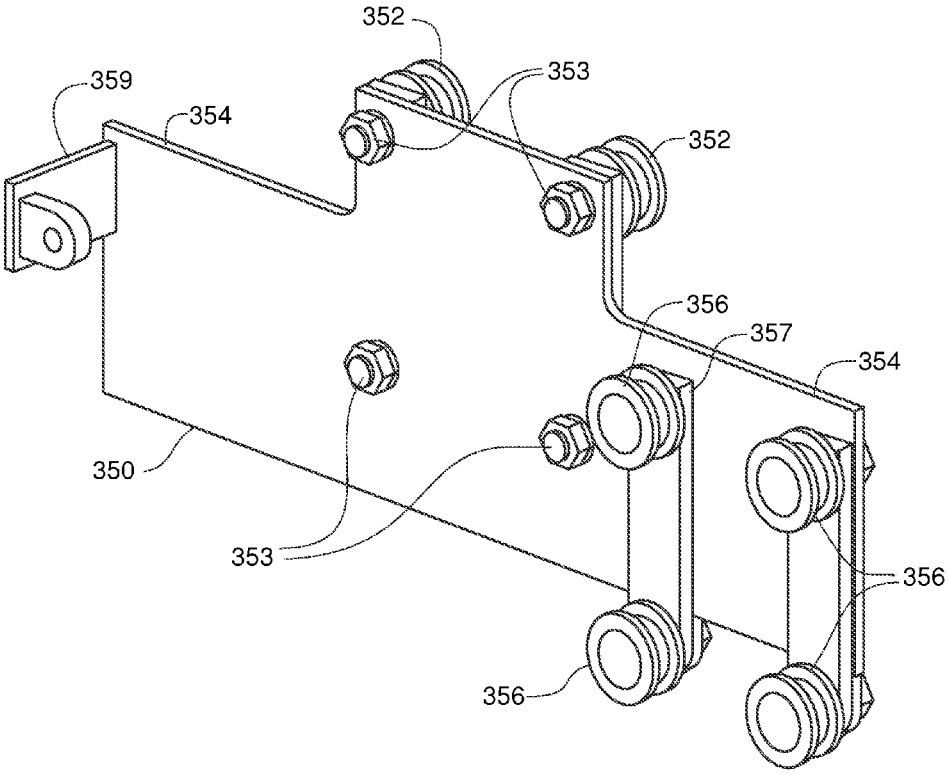
FIG. 7 is a perspective view of one component of the slide gate opener of FIG. 4.

FIG. 3 shows an embodiment on an opener 310 attached to a front side 302 of a tractor 300 using a tractor mount 304. FIG. 3 shows the primary components of the opener 310 in a simplified block manner when viewing the opener from above, but is not intended to show all elements to scale. The elements of FIG. 3 can be seen in a first embodiment shown in front plan view in FIG. 4, in perspective view in FIG. 5, and in perspective exploded view in FIG. 6. FIG. 7 shows in perspective view on component of the opener 310, namely the third plate 350 and the elements attached thereto.

The opener 310 attaches to the tractor mount 304 of the tractor 300 via a hinge 312. The hinge 312 allows the opener 310 to swivel about a pivot point 314 with respect to the tractor 300. The hinge 312 can be made of two sections, with a first section attached to the tractor mount 304 and the second section attached to a first plate 320, with each section permanently attached to its component, such as by welding, and then connected together to form the hinge by a hinge pin. Springs 316 on either side of the hinge 312 bias the first plate 320 to a position that is relatively parallel to the front side 302 of the tractor 300.

Attached to the first plate 320 opposite to the hinge 312 and springs 316 is a turntable device or bearing 330 that is able to turn a second plate 340 with respect to the first plate 320. This turntable device 330 is available from several sources including McMaster-Carr (Elmhurst, Ill.). The turntable 330 is preferable controllable by a hydraulic cylinder 332 (see FIG. 6) powered by the hydraulic system of the tractor 300. A control device 334 mounted near the driver actuates the hydraulic cylinder 332 through control lines 333, causing the turntable 330 to turn in either direction and thereby causing the tilting of the second plate 340 with respect to the first plate 320 and the tractor 300.

Attached to the second plate 340 are two rails 342 extending in a vertical direction. It is upon these rails 342 that the remainder of the opener (elements 350-376) can be raised vertically with respect to the tractor 300. A third plate 350 rides along these rails 342. In one embodiment, four wheels 352 on the third plate 350 ride on or within the rails 342. The location of these four wheels 352 is shown best in FIG. 7, which shows the attachment bolts 353 that are used to attach the four wheels 352 to the third plate 350. In one embodiment, hydraulic cylinder 344 is attached to the rails 342 and the third plate 350 so as to cause the third plate 350 to move upwards and downwards on the rails 342. Hydraulic power is provided by the tractor 300, and controls 334 near the driver cause plate 350 to rise and fall as necessary to align the tip 374 of the opener shaft 370 with pinion shaft, or slide gate controller, of the rail car.

In one embodiment, the third plate 350 is elongated horizontally at portions 354. In other embodiments, the third plate 350 is attached to an extension plate (not shown) in order to form an elongated single unit. Attached at one of the horizontally elongated portions 354 are four rollers 356. In the displayed embodiment, the rollers 356 are mounted on two extension plates 357 (shown in FIG. 7). The extension plates 357 serve two purposes, namely to allow a fourth plate 360 that is carried on rollers 356 to move freely without interference from the attachment bolts 353, and to allow the bottom pair of rollers 356 to be mounted below the bottom edge of the third plate 350.

The fourth plate 360 rides between the four rollers 356. This plate 360 is also elongated in a horizontal direction, and is situated within the rollers 356 so as to be moveable through rotation of the rollers 356. In one embodiment, a hydraulic cylinder 358 is attached to an extension 359 of the third plate. This cylinder 358 is also attached to the fourth plate 360. One of the controls 334 located near the driver of the tractor 300 controls this cylinder, which causes the fourth plate 360 to extend and retract sideways, generally parallel to the front 302 of the tractor. This allows the controller 334 to move this fourth plate 360 toward the gate controllers of the rail cars.

Mounted on the fourth plate 360 is a hydraulic motor 372 that rotates an opener shaft 370. The motor 372 can rotate the shaft 370 in either direction, and is also controlled by one of the hydraulic controllers 334 mounted near the operator of the tractor 300. The opener shaft 370 includes a tip 374 specially configured to mate with the pinion shaft on the rail car hopper gate. In the preferred embodiment, the tip 374 is removable and replaceable, thereby allowing the opener 310 to interact with hopper gates of multiple types of rail cars. In some embodiments, a support 376 is mounted on the fourth plate 360 to support the rotating shaft 370 as it is rotated by the motor 372.

Figure 8:
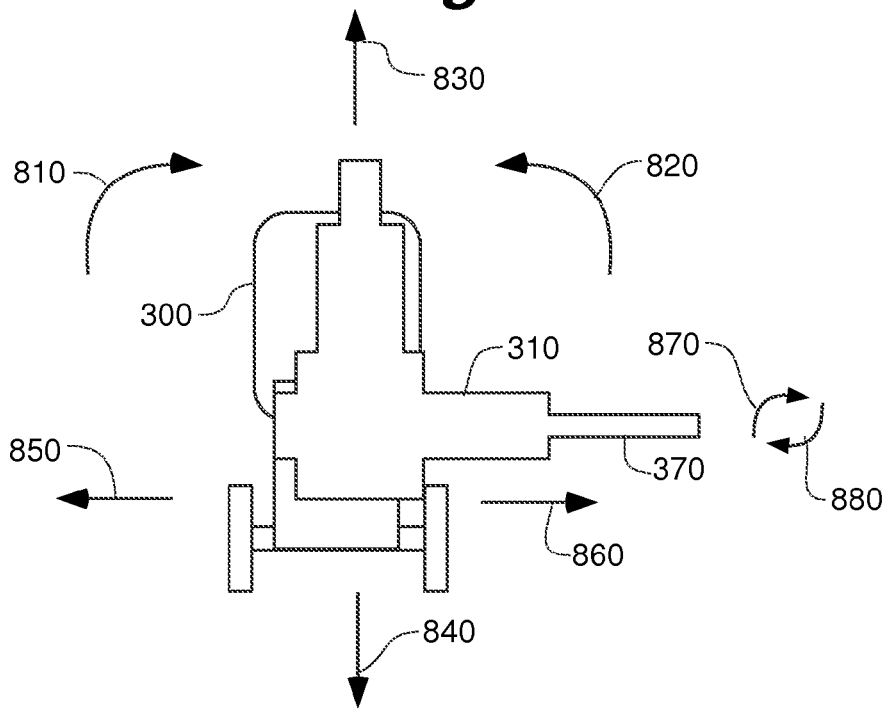
FIG. 8 is a schematic diagram showing six degrees of powered movement provided by one embodiment of the present invention in addition to the rotation of the opener shaft.
Figure 9:
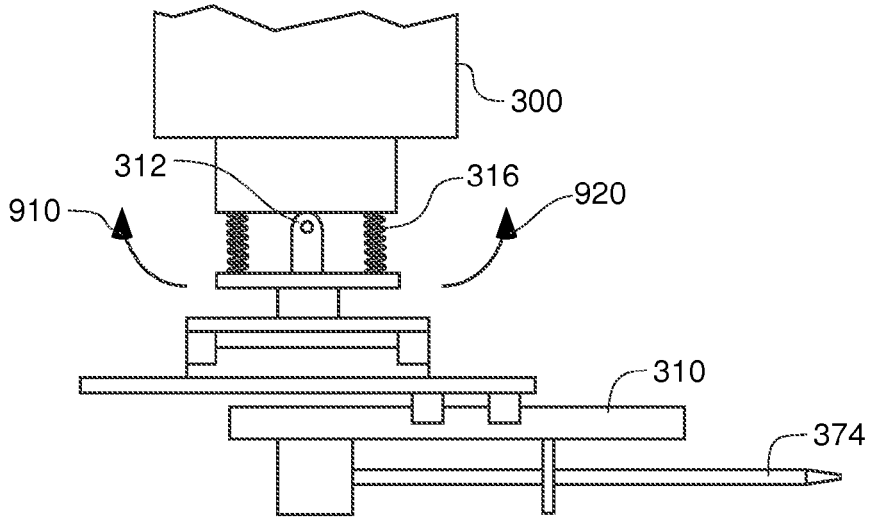
FIG. 9 is a schematic diagram showing two degrees of non-powered movement provided by the embodiment shown in FIG. 8.

FIGS. 8 and 9 shows eight degrees of movement that are possible using this embodiment of the present invention. Six of these degrees of motion are shown in FIG. 8 In particular, the opener 310 can be twisted with respect to the tractor 300 (as shown by arrows 810 and 820) by using a controller 334 that turns the turntable 330, can be raised and lowered with respect to the tractor 110 (as shown by arrows 830 and 840) by using a controller 334 that lifts and lowers the third plate 350 along rails 342, can be extended sideways (as shown by arrows 850 and 860) by using a controller 334 that moves the fourth plate 360 along rollers 354). Note that the movement shown by arrows 830 and 840 is along a first axis of movement (representing two directions along a single line). The movement shown by arrows 850 and 860 is along a second axis of movement (also representing two directions along a single line). This second axis of movement is perpendicular to the first axis of movement.

The last of the four controllers causes the motor 372 to rotate the opener shaft 370 clockwise 870 or counter-clockwise 880 to open or close the slide gate of the hopper car. As shown in FIG. 2, this allows a tractor 110 moving parallel to a rail road track to engage the opener shaft 140 with a pinion gear interface 150 of a hopper car slide gate 152 even if the tractor 110 is situated on land 112 that is above, below, or slanted upwards or downwards from the ground 162 on which rail road track resides.

Furthermore, as shown in FIG. 9, the hinge 312 and springs 316 allow for imperfect alignment between the shaft tip 374 and the receiving component on the pinion gear of the rail car hopper gate by allowing the shaft to twist in two additional degrees of motion 910, 920. With some hopper gates, the shaft 370 must not only rotate when opening a hopper slide gate but must also translate horizontally along with the hopper slide gate. In embodiments where this translation motion is required, the tractor can be driven slowly forwards or backwards parallel to the track to keep the tip 374 engaged while the shaft 370 rotates. The hinge 312 and spring 316 configuration is especially useful in this environment, as the swivel provided by these degrees of motion 910, 920 means that the tractor does not need to be driven precisely aligned with the pinion shaft on the slide gate of the hopper car to operate the slide gate.

Figure 10:
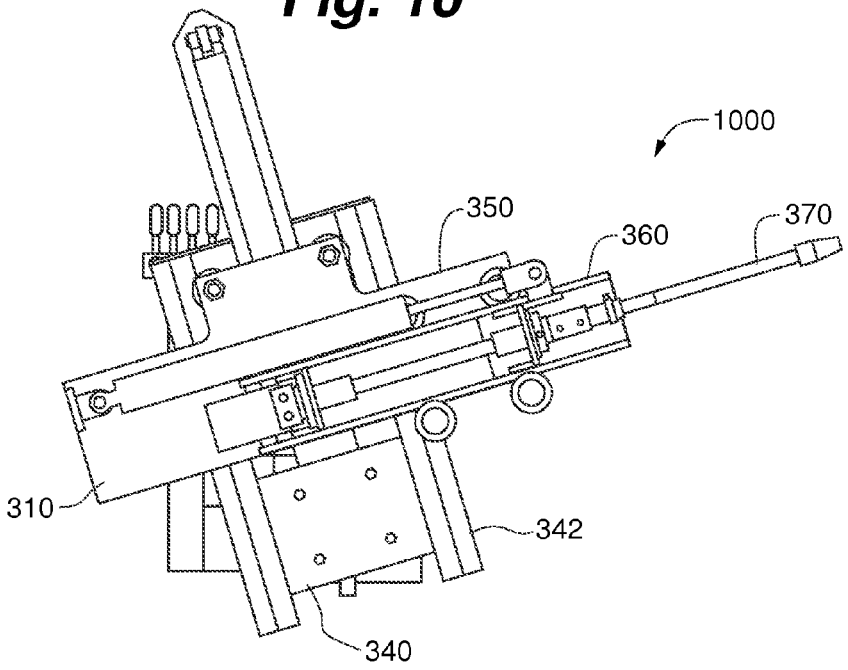
FIG. 10 is a front plant view of the slide gate opener of FIG. 4 in a first position.

FIG. 10 shows a first position 1000 assumed by the opener 310. In this position 1000, the third plate 350 has been raised on rails 342 to a high position, exposing plate 340. In addition, the turntable 330 has been caused to twist the opener shaft 370 upwards with respect to the tractor (not shown). Finally, the fourth plate 360 is at least partially retracted. This position 1000 would be useful if the ground on which the tractor resided were sloped downward toward the railroad track, which would mean that the opener shaft had to be tilted upwards to be level with the tracks on which the hopper car resides (in other words, the grounds slopes oppositely from the slope shown in FIG. 2).

Figure 11:
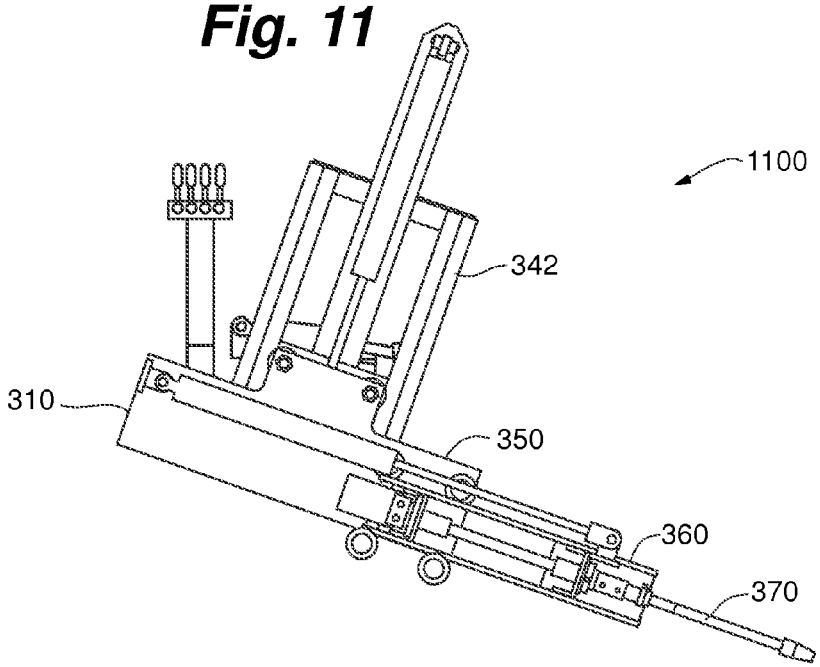
FIG. 11 is a front plant view of the slide gate opener of FIG. 4 in a second position.

FIG. 11 shows a second position 1100 assumed by the opener 310. In this position 1100, the third plate 350 has been lowered on rails 342 to a low position, hiding plate 340. In addition, the turntable 330 has been caused to twist the opener shaft 370 downwards with respect to the tractor (not shown), and the fourth plate 360 has been extended outward. This position 1100 would be useful if the ground sloped upward toward the railroad track and the opener shaft 370 therefore had to be tilted downwards to be level with the tracks on which the hopper car resides (in other words, the grounds slopes as shown in FIG. 2).

Figure 12:
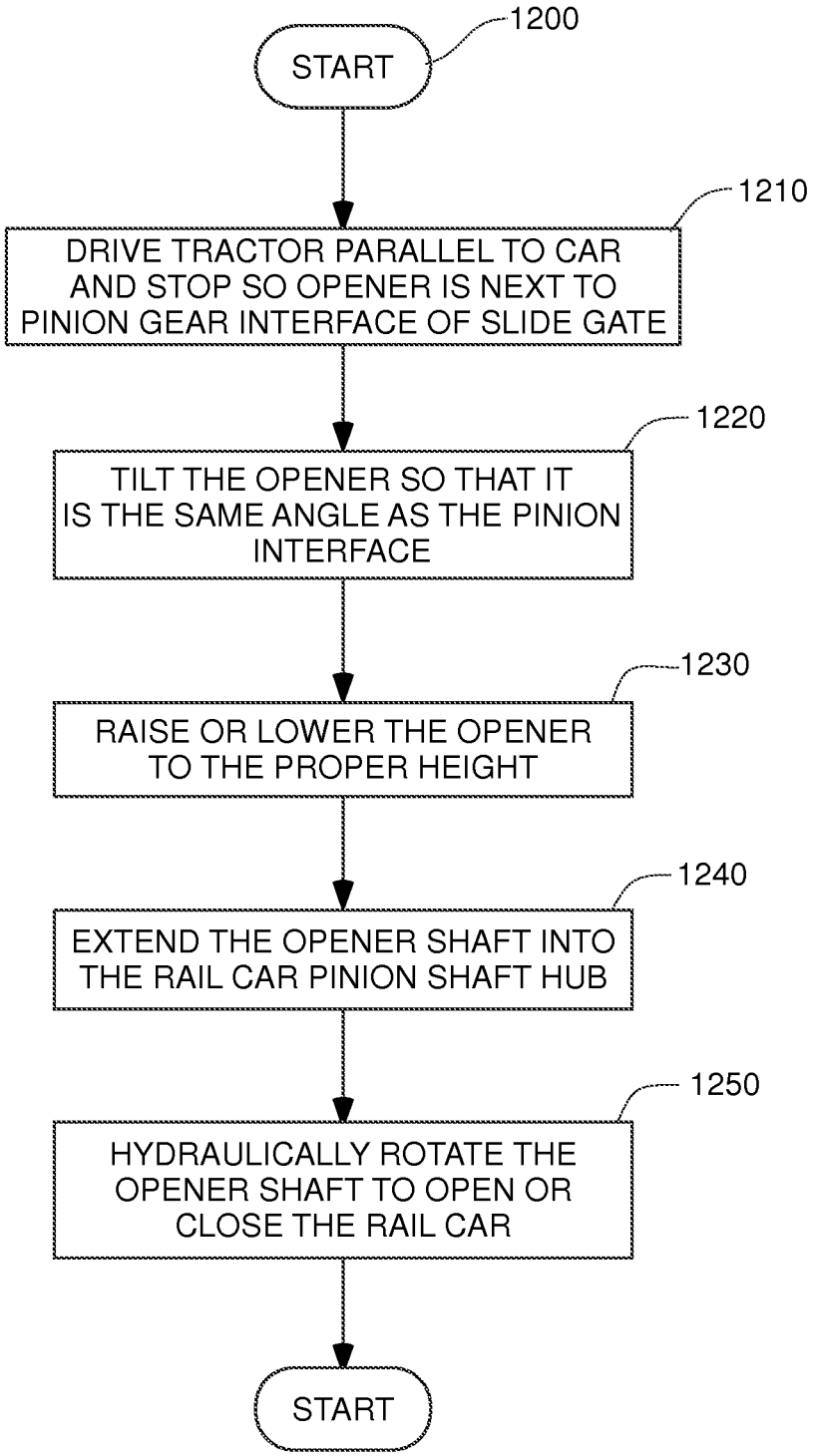
FIG. 12 is a flow chart of a method of using a slide gate opener attached to a tractor.

FIG. 12 shows a process 1200 for operating one embodiment of the rail car opener. The process 1200 starts at step 1210, as a driver drives a tractor parallel to a hopper rail car and then stops so that the opener shaft is next to the pinion gear interface of the slide gate. Next, at step 1220, the rail car opener is tilted by the operator with respect to the tractor so that the opener shaft is at the same angle as the pinion gear interface. Although the above description has assumed that the pinion gear interface requires engagement at an angle approximately parallel to the ground on which the hopper rail car sits, the present invention is easily able to handle alternative angle requirements.

At step 1230, the opener is raised or lowered so that the opener shaft is at the proper height to engage the pinion gear interface of the slide gate. At this point (step 1240), the opener shaft is extended away from the tractor and toward the pinion gear interface until the shaft tip engages with the pinion gear. Next (step 1250), the opener shaft is rotated so as to rotate the pinion gear with respect to the rack gear so as to open the slide gate of the hopper rail car. In some situations, it will be necessary to move the tractor forward or backward to keep the shaft engaged with the pinion gear if the pinion gear itself translates during the opening and closing of the slide gate.

The many features and advantages of the invention are apparent from the above description. Numerous modifications and variations will readily occur to those skilled in the art. Since such modifications are possible, the invention is not to be limited to the exact construction and operation illustrated and described. Rather, the present invention should be limited only by the following claims.

What is claimed is:

1. A method for opening a slide gate of a hopper rail car using a slide gate opener attached to a tractor, the hopper rail car resting on generally level rails and the tractor riding on wheels over unlevel ground that is adjacent to the rails and that approaches the rails with a slope, the method comprising:

a) adjusting a tip of a shaft on the opener to interface with a pinion gear interface of the rail car hopper gate by:

i) tilting the rail car opener with respect to the tractor and the unlevel ground by rotating a turntable such that the opener shaft tilts with respect to the unlevel ground to be parallel with the rails, thereby compensating for the slope;

ii) raising the opener with respect to the tractor;

iii) extending the opener shaft so as to interface the tip with the pinion gear interface; and b) rotating the opener shaft to move the rail car hopper gate.

2. The method of claim 1, wherein the step of rotating of the opener shaft comprises engaging a hydraulic motor, and further wherein the steps of tilting, raising, and extending each comprise actuating a separate hydraulic cylinder.

3. The method of claim 2, wherein the hydraulic motor is engaged and the hydraulic cylinders are actuated using hydraulic controllers with a separate controller for each of the three hydraulic cylinders and the hydraulic motor.

4. The method of claim 1, wherein the tractor has a front end, rear end, left end, and right end, and wherein the opener is attached to one of the front and rear ends;

further wherein the step of extending the opener shaft comprises extending the opener shaft laterally away from one of the right and left sides of the tractor.

5. The method of claim 4, further comprising:

c) driving the tractor forward, parallel to tracks upon which the hopper rail car resides;

d) stopping the tractor forward with the tractor generally parallel to the tracks and then performing steps a) and b) without re-aligning the tractor.

6. A slide gate opener for opening a slide gate of a hopper rail car, the slide gate having a pinion gear interface, the slide gate opener having:

a) a tractor mount;

b) a twisting turntable with a first side and a second side, the first side of the turntable fixed to the tractor mount;

c) a first element slidably mounted to the second side of the turntable such that the first element can slide in both directions relative to the second side of the turntable along a first axis of movement, wherein twisting of the turntable twists the first axis of movement relative to the tractor mount;

d) a second element slidably mounted to the first element such that the second element can slide in both directions relative to the first element along a second axis of movement, wherein the second axis of movement is perpendicular to the first axis of movement, wherein twisting of the turntable twists the second axis of movement relative to the tractor mount; and e) a rotating shaft attached to the second element.

7. The slide gate opener of claim 6, wherein the first element consists of a first plate fixedly attached to the second side of the turntable, and a second plate slidably attached to the first plate.

8. The slide gate opener of claim 7, wherein the second plate is slidably attached to the first plate via a first set of wheels running along rails.

9. The slide gate opener of claim 8, wherein the rails are attached to the first plate, and the first set of wheels are attached to the second plate.

10. The slide gate opener of claim 9, wherein the second element comprises a third plate that runs along a second set of wheels attached to the second plate.

11. The slide gate opener of claim 10, wherein the first set of wheels are attached to a first side of the second plate, and the second set of wheels are attached to a second side of the second plate.

12. The slide gate opener of claim 11, wherein the rotating shaft is attached to a motor, further wherein the motor is attached to the third plate of the second element.

13. The slide gate opener of claim 6, wherein a first hydraulic cylinder moves the first element relative to the second side of the turntable along the first axis of movement.

14. The slide gate opener of claim 13, wherein a second hydraulic cylinder moves the second element relative to the first element along the second axis of movement.

15. The slide gate opener of claim 14, wherein a motor rotates the rotating shaft.

16. The slide gate opener of claim 15, wherein the motor comprises a hydraulic motor.

17. The slide gate opener of claim 16, wherein a third hydraulic cylinder controls rotation of the turntable.

18. The slide gate opener of claim 6, wherein the first side of the turntable is fixed to the tractor mount via a hinge and a plurality of springs that bias the first side of the turntable to a generally centered position on the hinge.

19. A system for opening a slide gate comprising:

a) a tractor having a hydraulic system, the tractor having a front end, a left side, a right side, and a seat facing the front end of the tractor;

b) controls interfacing with the hydraulic system of the tractor, c) hydraulic hoses connected to the controls, d) a slide gate opener attached to the front end of the tractor having:

i) a rotating shaft having a pinion gear interface tip, the rotating shaft extending a first direction, the first direction chosen from a leftward and a rightward direction that is generally parallel to the front end of the tractor;

ii) a first means for tilting the rotating shaft up and down;

iii) a second means for raising and lowering the rotating shaft;

iv) a third means for extending and retracting the rotating shaft along the first direction.

20. The system of claim 19, wherein the first, second, and third means are connected to the hydraulic hoses and are each controlled by a separate one of the controls; and wherein the system further comprises a fourth means for swiveling the rotating shaft a small amount forward and backward.

* * * * *